US009517171B2

(12) United States Patent
Andersen et al.

(10) Patent No.: US 9,517,171 B2
(45) Date of Patent: Dec. 13, 2016

(54) BED, PREFERABLY HOSPITAL OR CARE BED

(75) Inventors: Thomas Egelund Andersen, Sønderborg (DK); Morten Fog, Sønderborg (DK)

(73) Assignee: Linak A/S, Nordborg (DK)

( * ) Notice: Subject to any disclaimer, the term of this patent is extended or adjusted under 35 U.S.C. 154(b) by 536 days.

(21) Appl. No.: 12/226,599

(22) PCT Filed: Apr. 27, 2007

(86) PCT No.: PCT/DK2007/000200
§ 371 (c)(1),
(2), (4) Date: Oct. 23, 2008

(87) PCT Pub. No.: WO2007/124748
PCT Pub. Date: Nov. 8, 2007

(65) Prior Publication Data
US 2009/0064414 A1 Mar. 12, 2009

(30) Foreign Application Priority Data
Apr. 27, 2006 (DK) ..... 2006 00596

(51) Int. Cl.
*A61G 7/012* (2006.01)
*A47C 19/04* (2006.01)
*A61G 7/05* (2006.01)

(52) U.S. Cl.
CPC ..... *A61G 7/012* (2013.01); *A47C 19/045* (2013.01); *A61G 7/05* (2013.01); *A61G 2203/726* (2013.01)

(58) Field of Classification Search
CPC .... A61G 7/05; A61G 7/012; A61G 2007/052; A61G 2007/0521; A61G 2007/0524;A61G 2203/70; A61G 2203/72; A61G 2203/726; A47C 19/045; G01V 8/14; G01V 8/22
(Continued)

(56) References Cited

U.S. PATENT DOCUMENTS 3,623,057 A * 11/1971 Hedin et al. ..... 340/557
3,958,283 A * 5/1976 Adams et al. ..... 5/616
(Continued)

FOREIGN PATENT DOCUMENTS

JP 20021258/07 5/2002
JP 2002125808 5/2002

OTHER PUBLICATIONS

English Abstract of JP 2002125807.
English Abstract of JP 2002125808.

*Primary Examiner* — Nicholas Polito
(74) *Attorney, Agent, or Firm* — Dykema Gossett PLLC

(57) ABSTRACT

Bed, comprising a lower frame (1) and an upper frame (2) with a supporting surface for a mattress, and where the upper frame (2) is connected to the lower frame (1) so that the upper frame can be raised and lowered in proportion to the lower frame by means of one or more adjusting means (5, 6) driven by an electric motor. In order to prevent squeezing between the upper and lower frame when the upper frame is lowered, the bed is provided with anti squeezing means. These comprise a light source and a receiver positioned in a corner of the lower frame. The light source sends a light beam which follows the lower frame all the way around and runs just above the top side of the lower frame. When the light beam is interrupted the control unit reacts by cutting off the current for the motors.

4 Claims, 5 Drawing Sheets

(58) Field of Classification Search
USPC ..... 5/600, 611, 424, 905; 250/221, 222.1
See application file for complete search history.

(56) References Cited

U.S. PATENT DOCUMENTS

| | | | | |
|---|---|---|---|---|
| 4,534,077 | A | 8/1985 | Martin | |
| 6,201,481 | B1 | 3/2001 | Bellingroth | |
| 6,336,235 | B1 * | 1/2002 | Ruehl | 5/610 |
| 2004/0231052 | A1 | 11/2004 | Gladney | |
| 2004/0252384 | A1 * | 12/2004 | Wallerstein et al. | 359/725 |
| 2006/0010601 | A1 * | 1/2006 | Riley et al. | 5/600 |
| 2006/0145060 | A1 * | 7/2006 | Lin | 250/214 R |

* cited by examiner

| | | | | |
|---|---|---|---|---|
| Bit 30 | 1 | 1 | 0 | 0 |
| Bit 31 | 0 | 1 | 1 | 0 |

Table 1 - Run/Stop-table
1 = Set, 0 = Not Set

Timing diagram for IR-transmitter and IR- receiver

Diagram 2 - Timing diagram for IR-transmitter and IR- receiver [µs]
Transmitter blue, Receiver red

Diagram 1 – Flow diagram of the Anti Entrapment system

BED, PREFERABLY HOSPITAL OR CARE BED

BACKGROUND OF THE INVENTION

Field of the Invention

The invention relates to a bed, preferably a hospital or care bed.

The Prior Art

Hospital and care beds typically include a lower frame furnished with drive wheels and an upper frame connected to the lower frame so that the upper frame as a whole can be elevated or tilted, enabling the patient to be positioned head down or head up (Trendelen-burg, anti Trendelenburg position, respectively). The movement is brought about either by means of lifting columns or actuators in connection with a link mechanism. An example of such a bed is for instance known from EP 0 488 582A2 to Huntleigh Technology plc. Altogether, it is definitely dangerous in case a person is directly squeezed in such a construction or indirectly for instance with an implement such as a floor mop. It is also experienced that patients fall out of bed and land on the foot switches, and thereby setting the bed in motion. In order to counter squeezing, the use of contact strips, which cut off the current for the motors, are for instance suggested in DE 198 14 269 to Okin and U.S. Pat. No. 4,534,077 to Martin. JP 2002 125807 to Paramount deals with a bed, where two parallel light sources with corresponding photoelectric cells are mounted under the upper frame, or more specifically at the connection of the link mechanism to the upper frame, and when the light beam is interrupted, the upper frame is stopped, alternatively elevated. In WO 03/088885 A1 to Hill-Rom a number of embodiments for squeeze protection are described based on light carpets and sophisticated positioning of light sources and light receivers.

The present invention relates to the type of squeezing protection, indicated in FIG. 12 of WO 03/088885 A1, where a light source and corresponding receiver are positioned above each side of the lower frame, at its side members. To avoid interference the light sources are located opposite each other on the two side members, so that the light is sent in opposite directions. A further light source and receiver is located at the foot of the bed. These are positioned on the external facade of the traverse, so that they do not collide with the light beams above the side members. As the light source is located on the side of the traverse, it does not provide any direct protection against squeezing from the upper frame. At the bed head of the bed, no protection against squeezing is provided even though hospital and care beds are frequently transported and left standing freely.

The purpose of the invention is to provide a more complete covering squeezing protection of this type.

SUMMARY OF THE INVENTION

This is achieved according to the invention by positioning the light source so that the light beam is sent all the way around along the top side of the lower frame, i.e., both the side members and both ends, so that it is directly prevented that something is squeezed under the bed. If a person rests his foot on the lower frame, the upper frame is prevented from moving, correspondingly if a child tries to climb under the bed. Washing of the floor under the bed by means of a mop, where the mop interrupts the light beam, will also prevent the bed from moving. This differs from the squeezing protection with contact strips as stated in DE 198 14 269 to Okin and the construction in JP 2002125807 to Paramount where the upper frame is in motion, and does not cut off the current for the motor for stopping the movement until contact is made. As a consequence of the inertia of the upper frame, some degree of squeezing will occur anyhow unlike the construction according to the invention where the upper frame cannot move at all if an unfamiliar object under the bed interrupts the light beam. One could object that it is not possible to adjust the bed while resting a foot on the lower frame, but on the other hand this beforehand prevents the foot from being squeezed. Compared with the above-mentioned construction in WO 03/088885 A1 to Hill-Rom, a protection against squeezing is obtained all the way around the bed, which among other things is of importance seeing that the beds are being transported around in hospitals or nursing homes and are often temporarily left standing freely in the room or in the hallways. In addition, the experience shows that even though a bed is positioned with its bed head against a wall, it does not prevent passage this way under the bed.

The light beam can be broadcasted over the top side of the upper frame in various ways, for example with mirrors positioned in the three corners and a light source and receiver in the last corner. A safer and more unambiguous-working embodiment is, however, to place a master unit with light source and receiver connected to the control unit in one corner of the lower frame while a slave, repeating the light signal, is placed in the other corners.

One could consider various options how the control unit must react, which is entirely dependent on the specific embodiment of the construction. Typically, the motor is brought to a halt and the control unit is prevented from lowering the upper frame further, but not from raising the upper frame. If convenient, the control unit can be arranged so that the actuators will automatically reverse for a short time, i.e., raise the upper frame a distance if the light beam is interrupted while the upper frame is on its way down.

An embodiment for the invention will be explained more fully below with reference to the accompanying drawings.

DETAILED DESCRIPTION OF THE PREFERRED EMBODIMENT

Figure 1:
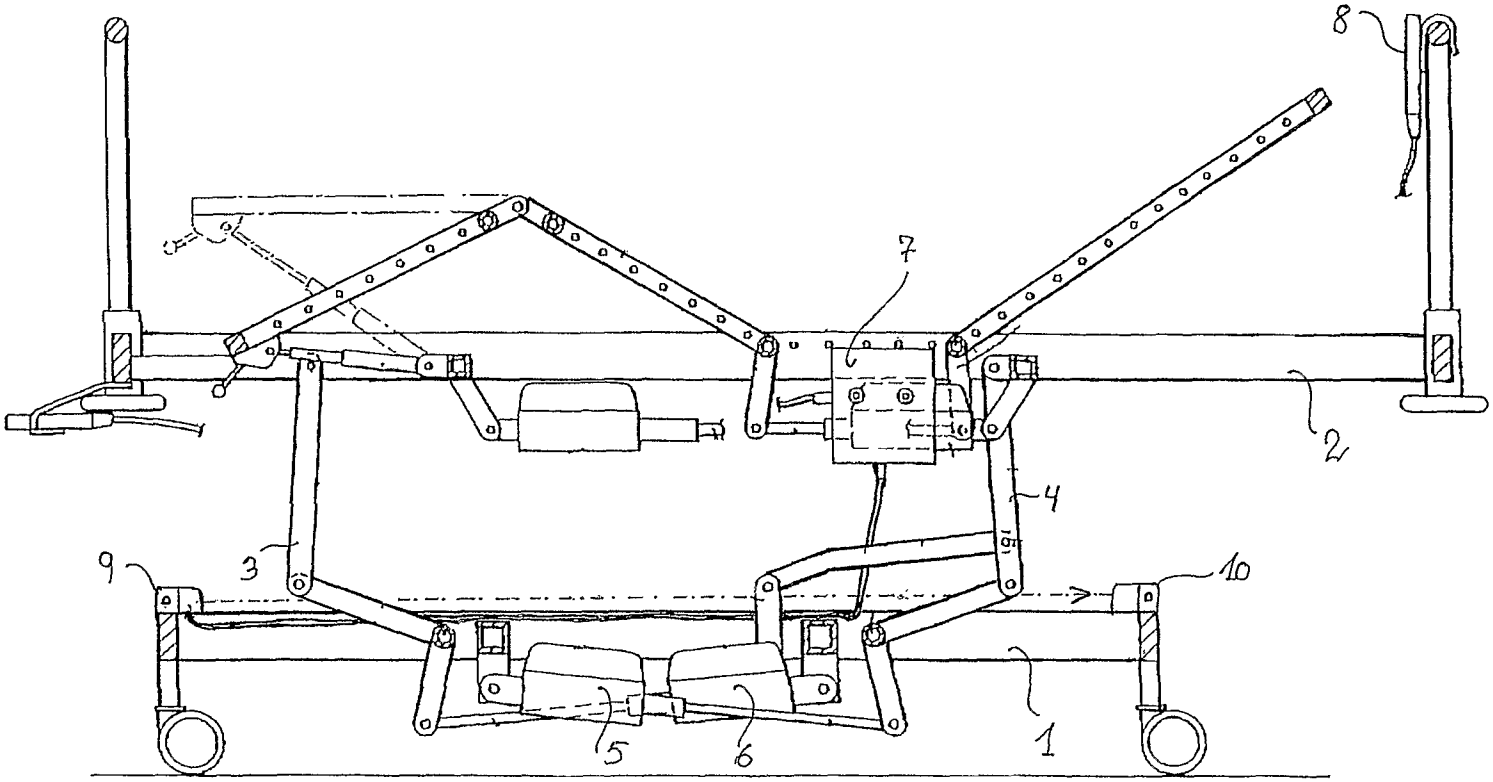
FIG. 1 shows a schematic view of a hospital bed.

The hospital bed shown in FIG. 1 of the drawing comprises a lower frame 1 equipped with drive wheels and an upper frame 2. On the upper frame is mounted an adjustable supporting surface for a mattress, which with actuators can be adjusted to assume various contours. The upper frame 2 is coupled to the lower frame by means of a link mechanism 3, 4 at each end. The upper frame can be raised and lowered by two actuators 5, 6 connected to the link mechanism. The actuators are linear actuators driven by a low voltage DC-motor of the type described in EP 531 247 B1, EP 647 799 B1 or WO 02/29284 all to Linak A/S. The actuators are connected to a control unit 7 comprising a power supply and a control. The actuators are operated by means of a hand control 8.

Figure 2:
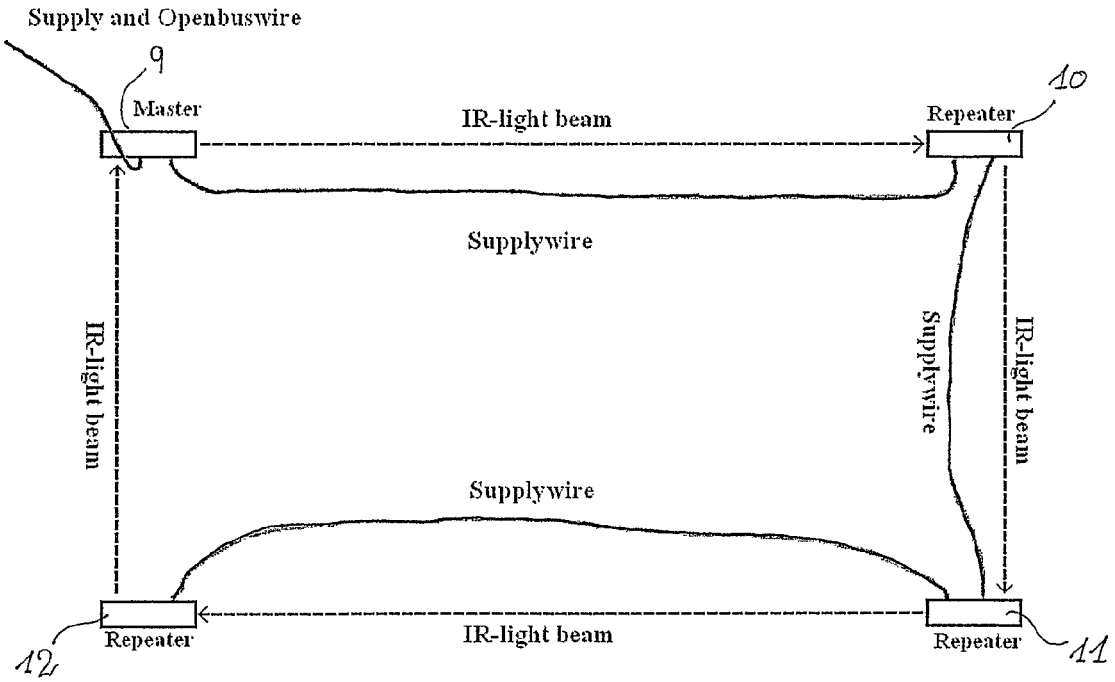
FIG. 2 shows a schematic view of the squeezing protection on the bed.

The bed is equipped with a protection against squeezing mounted on the top side of the lower frame 1 and the structure of the squeezing protection is suggested in FIG. 2. In one corner of the lower frame 1 is mounted a master 9 with a IR-transmitter, which sends a light beam directly along and immediately above one of the side members in the lower frame 1 to the adjacent corner, where a slave 10 is positioned, which receives and repeats the signal, and sends it along and immediately above the traverse by the foot of the bed to the adjacent corner, where a corresponding slave 11 is positioned, which sends the light on along the other side member of the lower frame to yet another slave 12 in the adjacent corner, which finally sends the signal back to the master 9 wherein a receiver is positioned. If the IR-signal is interrupted during its trip around the lower frame, a signal for stopping the actuators is sent to the control unit, and the control unit obstructs lowering the upper frame further, while it is still possible to raise the upper frame if it is found necessary.

Figure 6:
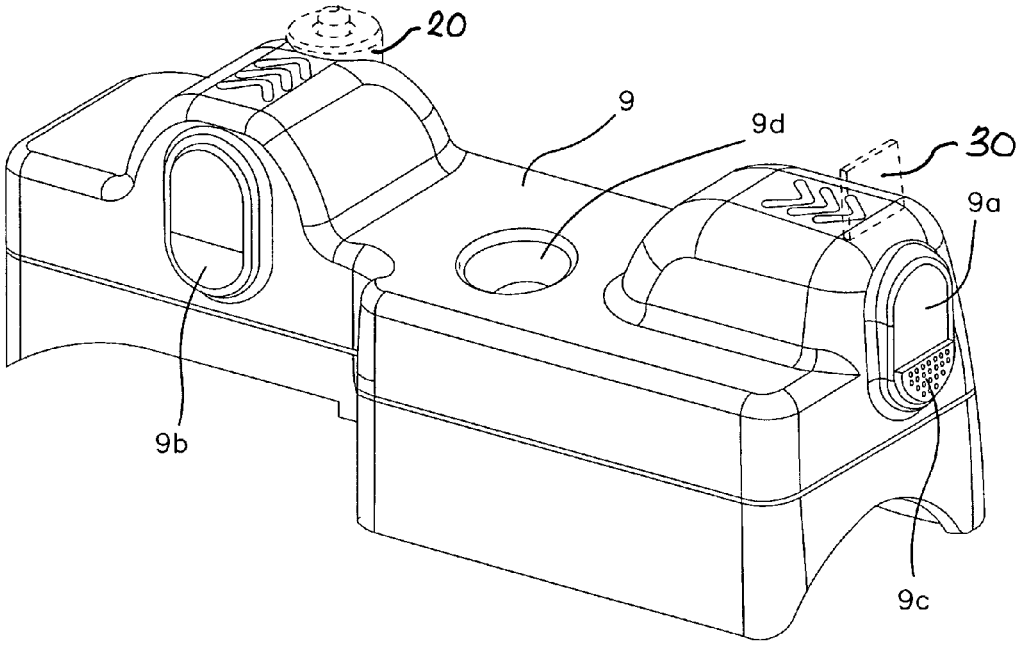
FIG. 6 shows a perspective view of a master with an IR-transmitter and receiver.

In FIG. 6 of the drawing a perspective view of a master 9 comprising an IR-transmitter and receiver is shown. The IR-transmitter sends a light beam through a lens/filter also known as the window 9*a*. The slaves 10-12 consist of a corresponding housing, but comprise a receiver/repeater, which receives and sends the light beam on until it returns to the master 9, where the light beam enters the window 9*b*. In order to ease the assembly process the direction of the light beam is indicated with arrows on top of the housings. In order to block disruptive reflections from the top side of the lower frame, the lower part of the lens/filter can have a matt finish 9*c*. As a matter of form, 9*d* indicates a screw hole for mounting on the lower frame.

Figures 3, 4:
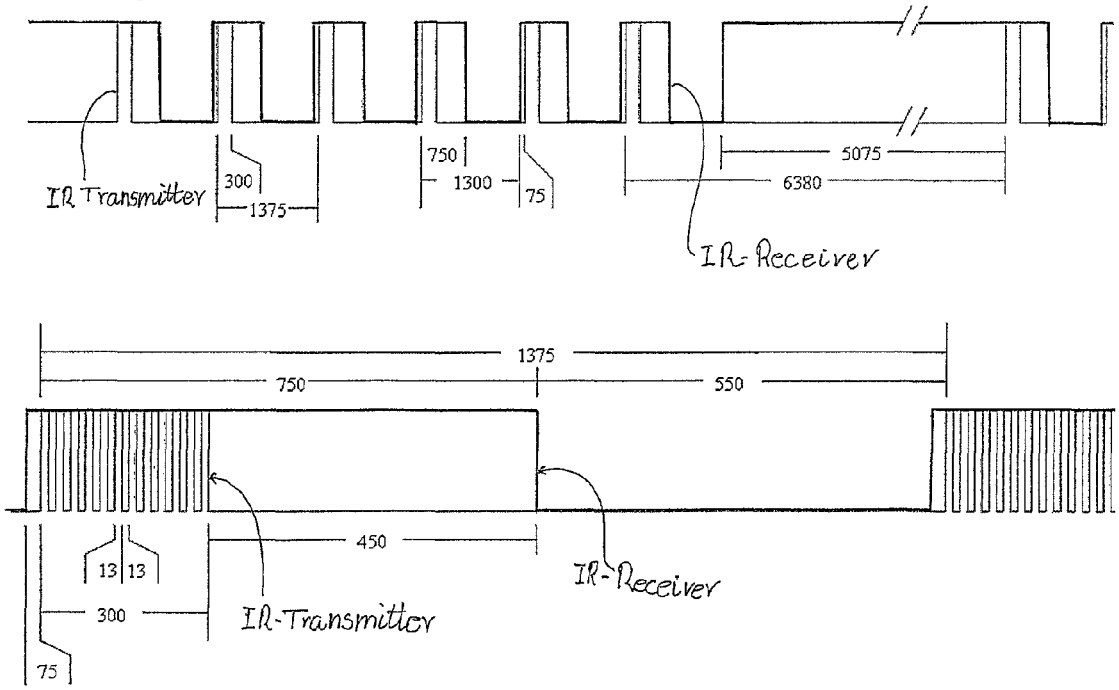
FIG. 3 shows a table.
FIG. 4 shows a timing diagram of IR-transmitter and IR-receiver.
Figure 5:
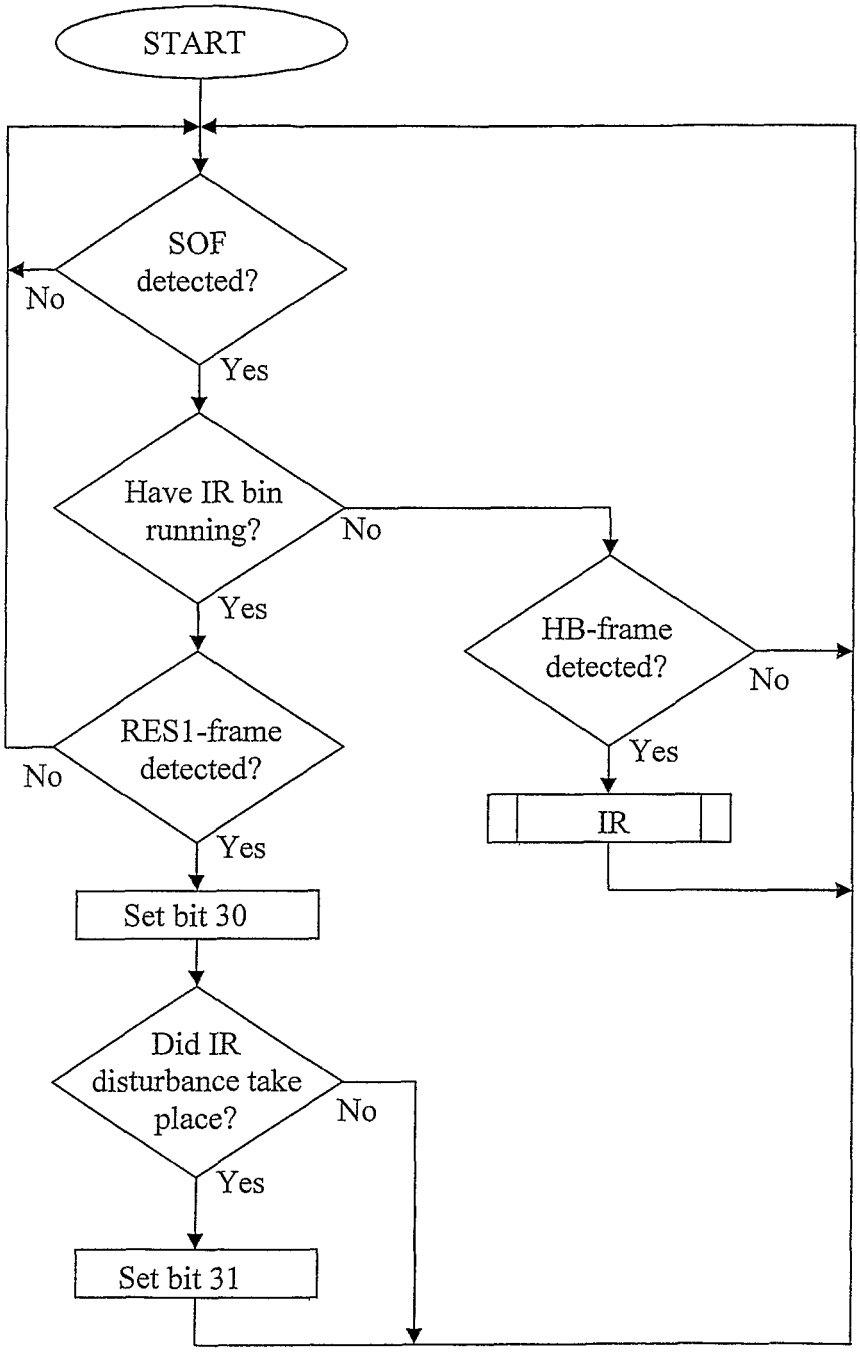
FIG. 5 shows a simplified flow chart of the method of operation of the squeezing protection.

The control unit can comprise a bus to which the various electric units such as actuators, hand controls, control panels, etc., can be connected. The master 9 of the squeezing protection can be connected to the bus correspondingly. For initiating the squeezing protection the master transmits six IR-impulses with 38 kHz modulation, and all six signals must be received and be at least 400 μs in order to be accepted. The master subsequently waits for a RESERVED 1-frame in the bus system and when detected, bit 30 is set to indicate that the squeezing protection system is connected to the control unit. Bit 31 is set, merely, if one of the received IR-impulses is below 400 μs. Timing diagram for IR-transmitter and IR-receiver is incidentally shown in FIG. 3. The control unit will stop a potential lowering of the upper frame if the system sets bit 31, cf. diagram FIG. 4. A simplified flow chart of the method of operation of the squeezing protection appears from FIG. 5 and this flow chart speaks for itself.

It is not very likely that something will get squeezed between the upper frame 2 and the upper side of the housings which constitute the master 9 and the slaves 10-12 without the light beam being interrupted. But to eliminate the possibility, a switch 20 for stopping the actuators if the upper frame is lowered can be positioned on the upper side of the master 9 and the slaves 10-12. Alternatively, a spring loaded plate 30, guided in the housings and protruding through an opening in the upper side can be located in the housings of the master and the slaves 10-12. If the plate is pressed downwards, it is pushed in the course of the light beam and interrupts the light beam. The spring load will ensure that the plate of its own again is pulled upwards and away from the course of the light beam when released.

The invention thus brings about a bed with an extensive protection against squeezing all the way around it.

The invention claimed is:

1. A bed comprising:

a lower frame equipped with drive wheels, and defining four corners, an upper frame having a supporting surface for a mattress, an adjusting means driven by an electric motor for raising and lowering the upper frame relative to the lower frame, a control unit which can be activated with a controller for controlling the adjusting means, and squeezing protection means for preventing anything from being squeezed under the upper frame, said squeezing protection means comprising a light source master means on the top side of a first corner of the lower frame, a first repeater means at a second corner, a second repeater means at a third corner, a third repeater means at a fourth corner, and a detector means near said light source master means which is connected to said electric motor, said light source master means emitting a single first light beam directly at said first repeater means, said first repeater means, upon receipt of said single first light beam, emitting a single second light beam directly at said second repeater means, said second repeater means, upon receipt of said single second light beam, emitting a single third light beam directly at said third repeater means, and said third repeater means, upon receipt of said single third light beam, emitting a single fourth light beam directly at said detector means, so that interruption of any one of said first, second, third or fourth light beams will prevent said fourth light beam reaching said detector means and thus cause said control unit to stop said electric motor, and wherein each of the light source master means, the first repeater means, the second repeater means and the third repeater means includes a respective housing having an opening for transmitting a light beam and an opening for receiving a light beam, further including a switch mounted on an upper side of each housing, which when activated when the upper frame is lowered, stops the electric motor.

2. The bed according to claim 1, wherein each of the first, second and third repeater means are positioned on the top side of the lower frame.

3. The bed of claim 1 wherein the control unit is further configured to reverse for a time said electric motor to thereby raise said upper frame a distance.

4. The bed of claim 1 wherein each of the light source master means, the first repeater means, the second repeater means and the third repeater means includes the respective housing having a respective lens in the opening for transmitting the light beam and a respective lens in the opening for receiving the light beam, wherein a lower part of at least one of said lenses has a matte finish to block disruptive reflections.

* * * * *